US006149579A

United States Patent [19]

Lee

[11] Patent Number: 6,149,579

[45] Date of Patent: Nov. 21, 2000

[54] SEMEN STORAGE CONTAINER AND ITS STOPPER

[76] Inventor: Won Ku Lee, 203-2004 Garak Ssangyon, Apt. 140 Garak-don, Songpa-ku, Seoul, Rep. of Korea

[21] Appl. No.: 09/201,399

[22] Filed: Nov. 30, 1998

[30] Foreign Application Priority Data

Mar. 23, 1998 [KR] Rep. of Korea ..... 98-9895
Oct. 16, 1998 [KR] Rep. of Korea ..... 98-43374

[51] Int. Cl.[7] ..... A61D 19/02

[52] U.S. Cl. ..... 600/35; 604/404; 383/906; 222/541.2

[58] Field of Search ..... 600/33, 34, 35, 600/906, 403, 404, 407, 408, 409; 215/47; 383/202, 906; 222/92, 527, 529, 541.2

[56] References Cited

U.S. PATENT DOCUMENTS 2,104,031 1/1938 Graber ..... 604/403
3,266,682 8/1966 Schultz ..... 222/92
5,249,716 10/1993 O'Sullivan ..... 222/527
5,391,163 2/1995 Christene et al. ..... 604/408
5,665,238 9/1997 Wiesman ..... 210/649
5,866,007 2/1999 Whitson et al. ..... 210/649
5,983,661 11/1999 Wiesman ..... 62/457.1

*Primary Examiner*—Samuel G. Gilbert
*Assistant Examiner*—Joseph Cadugan
*Attorney, Agent, or Firm*—Nathan N. Kallman

[57] ABSTRACT

A semen storage container containing the semen of a male pig is sealed with a stopper having a cone-shape vomiting portion whose point is closed at one end when the semen is used for artificial insemination, a predetermined portion of the cone-shape vomiting portion of the stopper is cut inserted into an insertion tube which is then inserted into the womb of female pig, thereby easily and cleanly carrying out artificial insemination. A window for confirming the amount of semen stored is added to the semen storage pack who se exterior is shading-printed to block a harmful ray of light such as direct ray of light, protecting the semen from deterioration.

5 Claims, 7 Drawing Sheets

(FRIOR ART)

(FRIOR ART)

SEMEN STORAGE CONTAINER AND ITS STOPPER

BACKGROUND OF THE INVENTION

1. Field of the Invention

The present invention relates to a semen storage container for storing the semen of a male pig, and in particular, to a semen storage container and its stopper, which stores the semen of a male pig and allows the stored semen to be cleanly put into the womb of female pig without difficulty when the stored semen is used for artificial insemination.

2. Discussion of Related Art

In the prior art approach; for artificial insemination of a female pig, the semen from a male pig is stored in a semen storage container (a bottle, tube or vinyl pack is usually used), and this semen is put into the womb of female pig. A conventional semen storage container is constructed in such a manner, as shown in FIG. 1, that a space for storing the male pig's semen is provided inside a semen storage pack 100 thermal press the semen is poured into the inner space of semen storage pack 100 through its inlet 110. In order to store the semen, inlet 110 is thermal-pressed after the semen is poured into semen storage pack 100, thus being sealed completely.

FIG. 2 shows a configuration for putting the semen stored in storage pack 100 into the womb of female pig using an insertion tube 120. The sealed part of inlet 110 of semen storage pack 100 is opened and insertion tube 120, a tube for one-time use, is press-fitted into inlet 110. Then, the end 121 of insertion tube 120 is inserted into the womb to put the semen of male pig, stored in semen storage pack 100, into the female pig's womb.

However, when the sealed inlet 110 of the semen storage pack is opened and the insertion tube 120 is put into the womb of female pig if the diameter of the insertion tube is different from that of the inlet 110 of the semen storage pack, the insertion tube cannot be fitted into the inlet. In other words, various kinds of insertion tubes whose diameters are different cannot be used for the inlet having a fixed diameter. That is, the semen storage pack is not compatible with various types of insertion tubes. Furthermore, the conventional semen storage pack produces unsanitary problems because the semen may leak from the gap between the inlet and insertion tube. Moreover, the semen storage pack is made of transparent vinyl, resulting in deterioration of semen due to its exposure to harmful rays of light.

SUMMARY OF THE INVENTION

An object of the present invention is to provide a semen storage container and its stopper, for improving the semen storage pack's compatibility with various kinds of insertion tubes having different diameters, sanitation and economic effect.

Another object of the present invention is to provide a semen storage container in which a window for confirming the amount of semen stored in a semen storage pack Another object of the invention is to provide a semen storage container for such as direct ray of light, protecting the semen from deterioration due to harmful rays of light.

In accordance with the present invention, a semen storage container, includes a stopper and a connection tube having a predetermined and a closed point. The connection tube is press-fitted into the inlet or outlet of the semen storage container. A cone-shape vomiting portion is connected to one end of the connection tube.

The present invention, includes an inlet that is connected to a hollow placed on its top, a connection tube whose one end is connected to a cone-shaped vomiting portion, which is press-fitted into the inlet, the point of the cone-shaped vomiting portion being closed, and a prominence for fixing the connection tube, the prominence being placed on a predetermined portion of the connection tube or cone-shaped vomiting portion.

BRIEF DESCRIPTION OF THE ATTACHED DRAWINGS

Figure 7A:
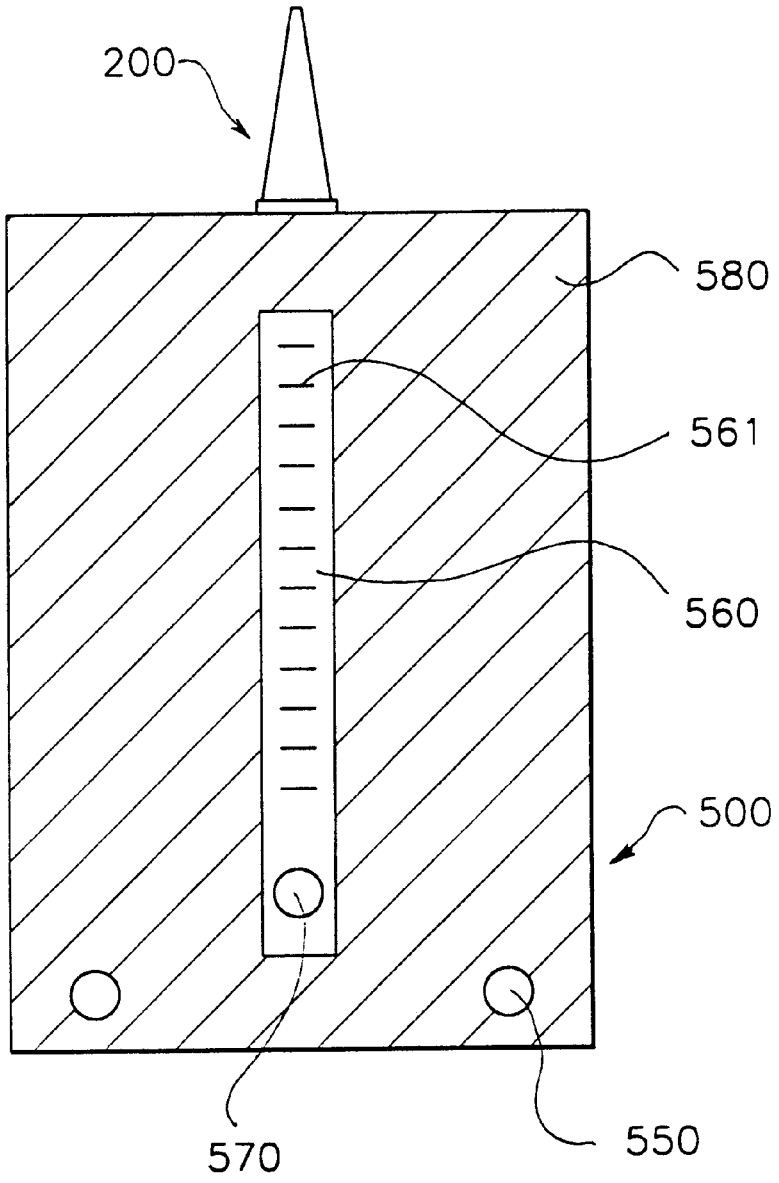
Figure 7B:
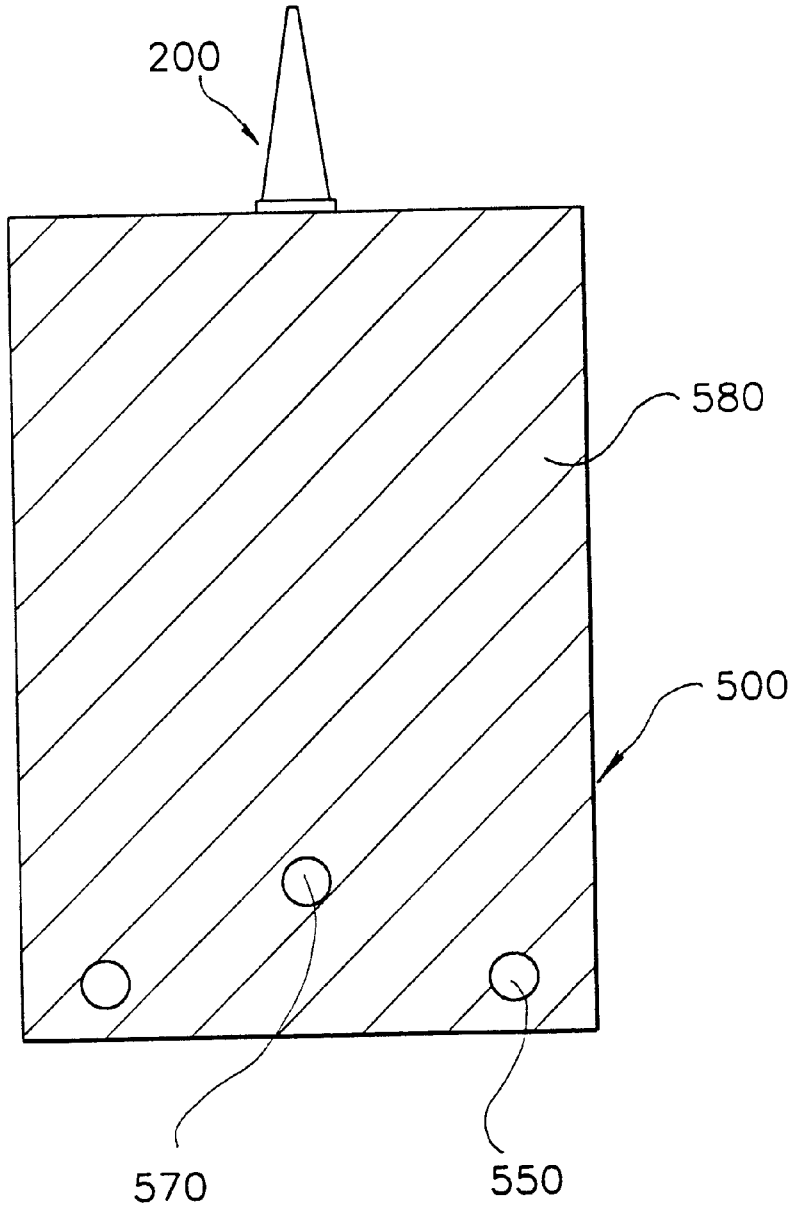

FIG. 7*a* is a front view and FIG. 7*b* is a rear view of the exterior of the semen storage container according to another embodiment of the present invention.

DETAILED DESCRIPTION OF PREFERRED EMBODIMENT

Figure 1:
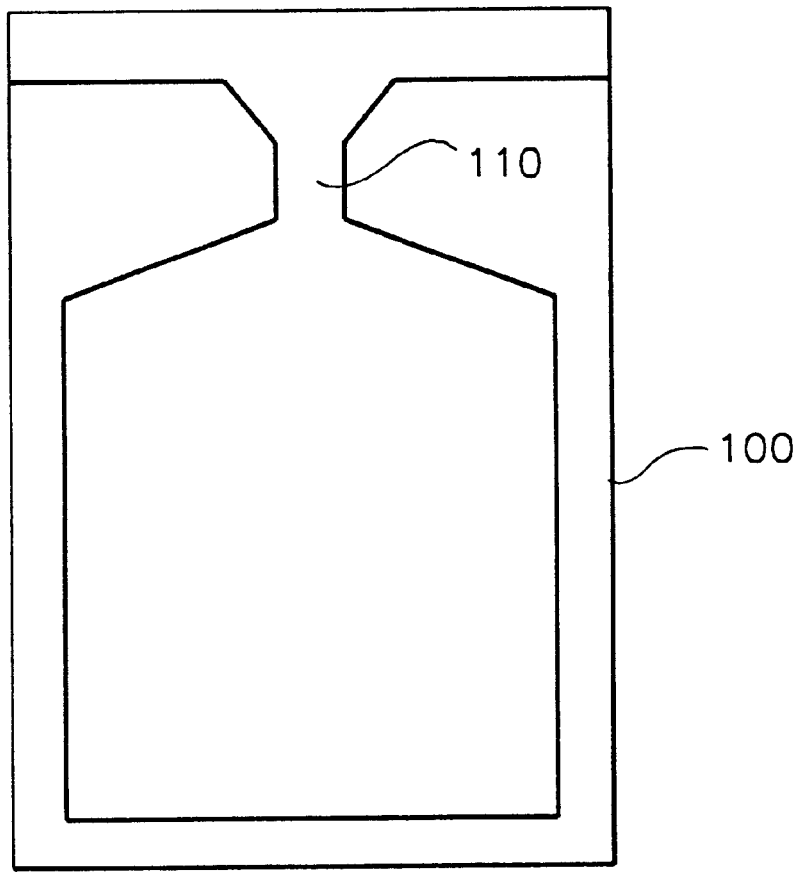
FIG. 1 shows a conventional semen storage container.
Figure 2:
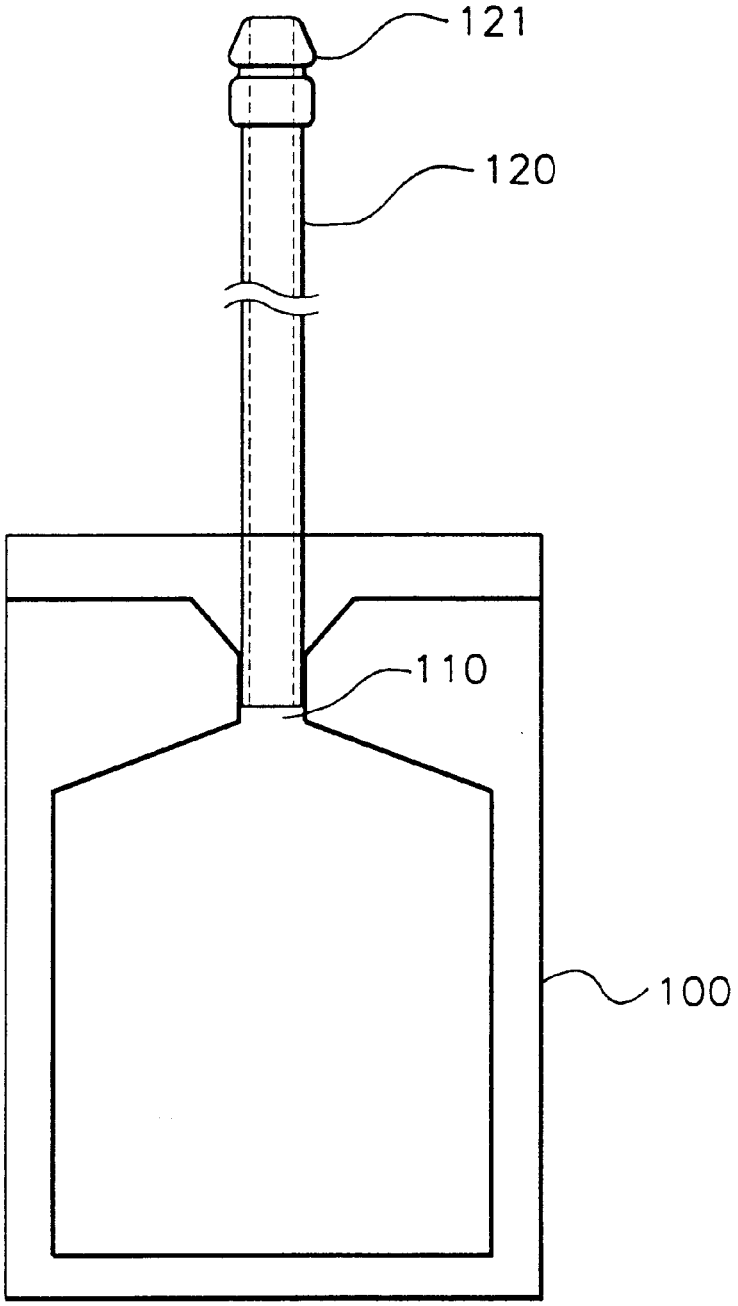
FIG. 2 shows a state where the insertion tube is inserted into the semen storage container of FIG. 1.
Figure 3:
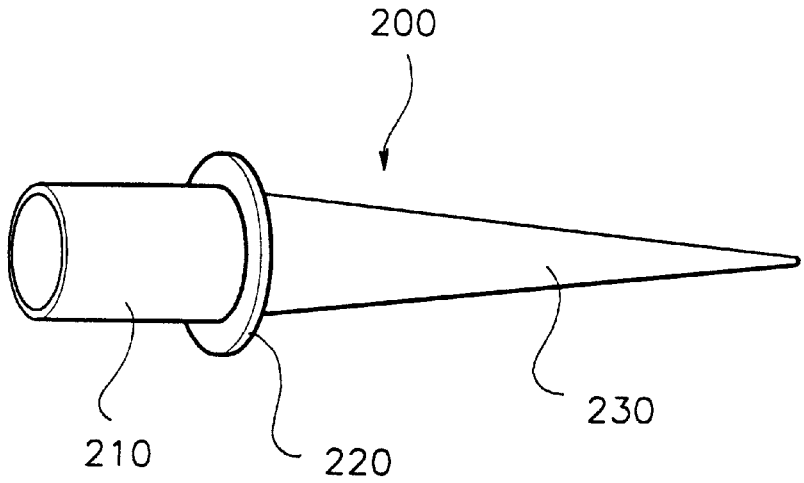
FIG. 3 shows a perspective view of the stopper of a semen storage container according to the present invention.
Figure 4:
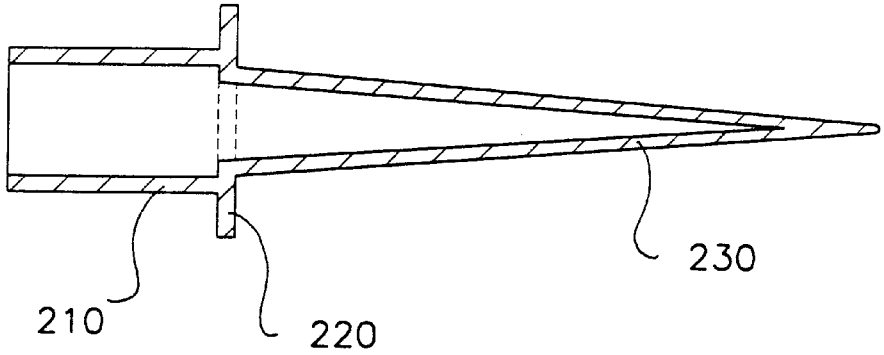
FIG. 4 is a sectional view of FIG. 3.

FIG. 3–4 illustrate a stopper 200 which is used with a semen storage container according to the present invention. A cylindrical connection tube 210 is press-fitted into an inlet 310 (see FIG. 5) of a semen storage pack for storing the semen. A cone-shaped vomiting portion 230 is formed at one end of connection tube 210, which end is opposite to its other end which is fitted into the inlet 310. A prominence 220 is placed on a predetermined portion of connection tube 210, to determine the depth of a portion of connection tube 210, that is press-fitted into the inlet of the semen storage container, and to fix connection tube 210 within the inlet. Connection tube 210 and cone-shape vomiting portion 230 whose point is closed are internally connected. Thus, when a predetermined portion of cone-shaped vomiting portion 230 is cut, the semen stored in the storage pack is vomited from cone-shaped vomiting portion 230 through connection tube 210.

Figure 5:
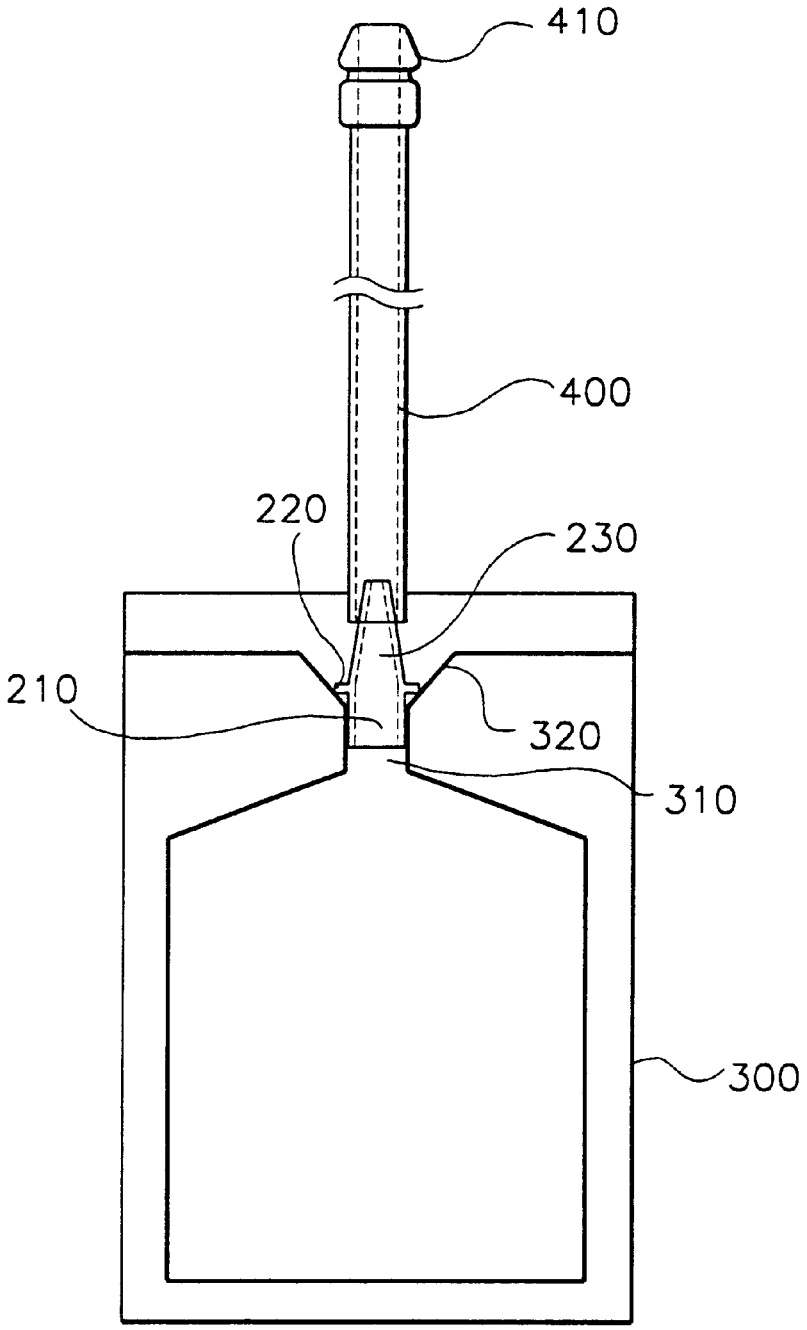
FIG. 5 shows a semen storage container of the present invention and configuration for using the container for artificial insemination.

With reference to FIG. 5, a space for storing the semen is formed inside semen storage pack 300 through a sealing process. The semen of a male pig is poured into the space through inlet 310. a sloped hollow portion 320 which is connected to inlet 310, to stably fix prominence 220 of stopper 200. Hollow portion 320 is also formed through sealing. After the semen of male pig is poured into semen storage pack 300, connection tube 210 of stopper 200 is press-fitted into inlet 310 of storage pack 300, to seal it. Here, prominence 220 sits on hollow 320 to allow connection tube 210 to be inserted and fixed within the storage pack at a proper depth.

When the semen stored is used for artificial insemination, a predetermined portion of cone-shaped vomiting portion 230 of the stopper is cut to open its point portion. By doing so, the liquid semen is vomited from cone-shape vomiting portion 230 through connection tube 210 of the stopper. Cone-shape vomiting portion 230 is inserted into an insertion tube 400 which is then inserted into the womb of a female pig, thereby putting the semen stored in storage pack 300 into the womb. Here, cone-shaped vomiting portion 230 of stopper 200 has different diameters in the direction of its length. Accordingly, it can be inserted into various kinds of insertion tubes with different diameters. That is, in case of a narrower insertion tube, cone-shaped vomiting portion 230 is inserted there into a little, and in case of wider one, it is inserted there into more. A piercing hole through storage pack 300, stopper 200 and insertion tube 400 is formed to allow the semen to flow into the female pig's womb.

Figure 6:
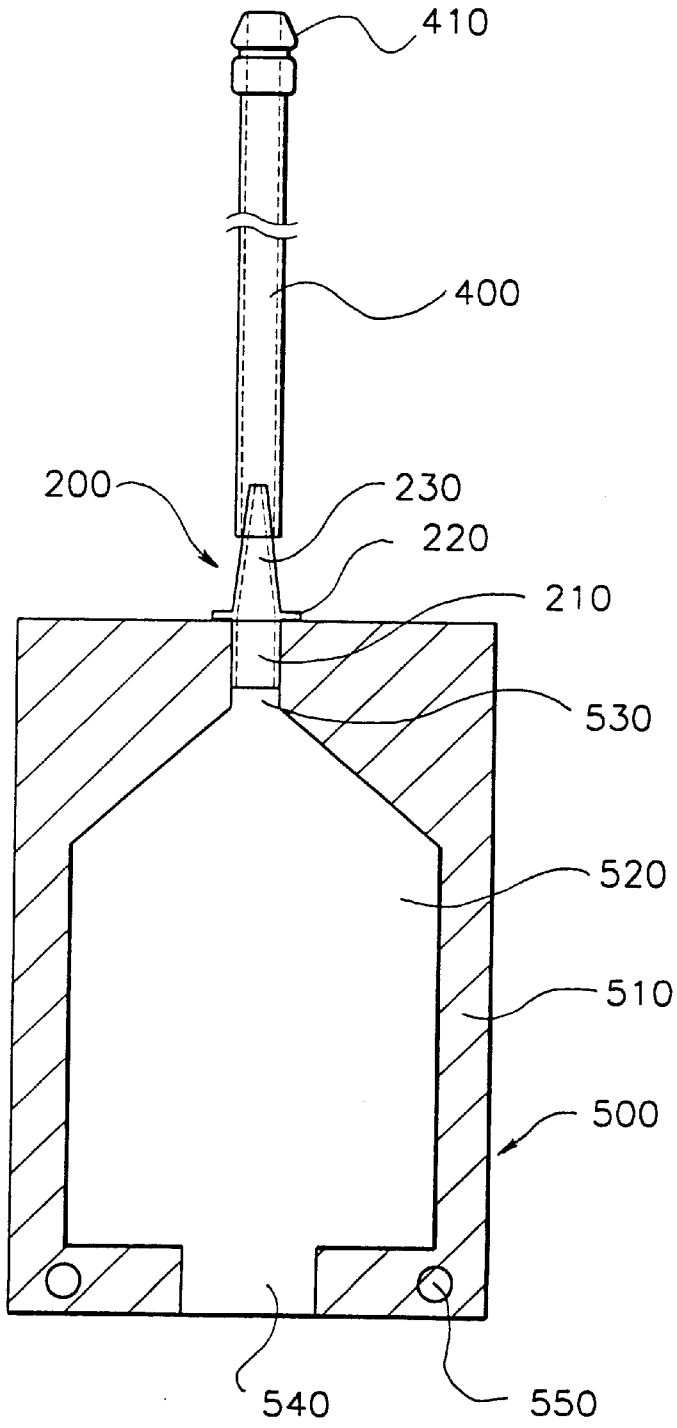
FIG. 6 shows another embodiment of the present invention.

A embodiment of the present invention is shown in FIGS. 6, 7*a* and 7*b*. An inlet 540 for pouring the semen into semen storage pack 500 is formed at the bottom of the storage pack, and an outlet 530 for vomiting the semen is formed at its top. Stopper 200 with a cone-shaped vomiting portion 230 whose point is closed is fixed into outlet 530 to allow the semen to be externally vomited through outlet 530 and stopper 200. A shading means 580 protects the semen from deterioration due to harmful rays of light. Cylindrical connection tube 210 of stopper 200 is inserted and fixed into outlet 530 of semen storage pack 500. One end of connection tube 210 is connected to cone-shaped vomiting portion 230. Prominence 220 is placed on a predetermined portion of connection tube 210 or cone-shaped vomiting portion 230 to easily determine the depth of a portion of connection tube 210, that is inserted into outlet 530 of storage pack 500, and to fix stopper 200 into the storage pack. A semen storing space 520 where the semen is stored is formed inside storage pack 500 through thermal press. The semen is poured into space 520 through inlet 540 placed at the bottom of storage pack 500.

After a specific amount of semen is poured into semen storing space 520, inlet 540 is sealed by thermal press. Connection tube 210 of stopper 200 is inserted into outlet 530 at the top of storage pack 500. In this state outlet 530 is sealed by stopper 200 so that cone-shaped vomiting portion 230 protrudes from storage pack 500. Prominence 220 of stopper 200 supports stopper 200 and fixes it into storage pack 500. The depth of a portion of connection tube 210, that is inserted into outlet 530 of the storage pack is easily determined.

In order to use the liquid semen stored for artificial insemination, a predetermined portion of cone-shaped vomiting portion 230 of stopper 200 is cut using a scissors or knife to open its point portion. By doing so, the semen stored in storage pack 500 is vomited from cone-shaped vomiting portion 230 through connection tube 210 of the stopper. Cone-shaped vomiting portion 230 is inserted into an insertion tube 400 whose end 410 is then inserted into the womb of a female pig, thereby putting the semen into the womb. Cone-shaped vomiting portion 230 of stopper 200 has different diameters in the direction of its length. Accordingly, it can be inserted into various kinds of insertion tubes with different diameters. That is, in case of a narrower insertion tube, cone-shaped vomiting portion 230 is inserted there into a little, and in case of wider one, it is inserted more. A piercing hole through storage pack 500, stopper 200 and insertion tube 400 is formed to allow the semen to flow into the female pig's womb. The semen storage container of the present invention also includes a shade 580 formed on its exterior, as shown in FIG. 7A, for blocking harmful ray of light thus protecting the semen stored in the storage pack. Shade 580 may be formed through printing using an ink or paint. In general, when the semen is exposed to direct rays of light, for example, the survival rate of its spermatozoon is remarkably decreased. Accordingly, it is preferable that semen storage pack 500 includes shade 580 so as not to directly expose the semen to the ray of light during its storage or artificial insemination.

Furthermore, there is a window for confirming the amount of semen, placed on a predetermined portion of the front or back of storage pack 500. This window 560 is easily formed in such a manner that, when shade 580 is printed, the printing is applied to a predetermined portion of the exterior of the storage pack other than the portion of window 560. Moreover, in order to precisely confirm the amount of semen through window 560, graduation markings 561 are printed on the window when shade printing is performed, to easily confirm the amount of semen charged in the storage pack or the amount vomited when used for artificial insemination.

Semen storage pack 500 further includes a transparent window 570 on a predetermined portion, to examine if the spermatozoon is alive through a microscope without opening of storage pack 500. As shown in FIG. 7B, transparent window 570 is located at the same portions of the front and back of storage pack 500, and it is formed during the shade printing. Specifically, shade 580 is formed by printing on a predetermined portion of the exterior of the storage pack, other than portions which are used for the the transparent window 570. By doing so, shade 580 and transparent window 570 are simultaneously formed. Through the transparent window 570, it is possible to examine whether the semen charged in storage pack 500 is alive or not. Moreover, a hanging hole 550 with a predetermined diameter is formed in a predetermined portion of thermal pressed portion 510 of the storage pack, to hold the storage pack easily.

According to the present invention, when the semen storage pack containing the semen is open for artificial insemination, various kinds of insertion tubes with different diameters can be used for the cone-shaped vomiting portion of the stopper, producing satisfactory results in terms of sanitation and economy. Furthermore, harmful rays of light are blocked to increase the spermatozoon's survival rate. Moreover, it is possible to easily confirm the amount of semen charged in the storage pack and the amount vomited during artificial insemination, and to examine if the spermatozoon is alive within the sealed storage pack.

It will be apparent to those skilled in the art that various modifications and variations can be made in the semen storage container and its stopper of the present invention without departing from the spirit or scope of the invention. Thus, it is intended that the present invention cover the modifications and variations of this invention provided they come within the scope of the appended claims and their equivalents.

What is claimed is:

1. A semen storage container comprising:

a semen storage pack;

an inlet for pouring semen into the storage pack, the inlet being connected to a hollow portion formed at the top of said storage pack;

a connection tube having an end connected to a cone-shaped vomiting portion, said cone-shaped vomiting portion being closed at one end; and a prominence formed with said connection tube for placing the connection tube at a predetermined position within said storage pack.

2. A semen storage container, comprising:

a semen storage pack;

an inlet for pouring an amount of semen containing spermatozoa into the semen storage pack, the inlet being disposed at the bottom of the semen storage pack;

an outlet from which the semen is vomited, and which is disposed at the top of the storage pack;

a stopper having a cone-shaped vomiting portion with a closed upper end, the stopper being set within the outlet to allow the semen to be externally vomited therefrom through the outlet; and a shade formed on the exterior of the semen storage pack, to protect the semen from deterioration due to harmful rays of light.

3. The semen storage container as claimed in claim 2, further comprises a window for confirming the amount of semen, which window is placed on a predetermined portion of the front or back of the semen storage pack.

4. The semen storage container as claimed in claim 2, further comprising transparent windows for confirming through a microscope if the semen's spermatozoa are alive, the transparent windows being respectively placed on the front and back of the semen storage pack at matching positions.

5. An assembly for storing semen comprising:

a semen storage container;

an inlet formed in said container for receiving semen;

an outlet formed in said container for ejecting semen;

a stopper for insertion into said outlet;

a connection tube having a predetermined length that is press fitted into said outlet;

a cone-shaped vomiting portion connected to an end of said connection tube; and a prominence formed at a predetermined portion of said connection tube for establishing the depth of a portion of the connection tube that is inserted into said outlet and for positioning said connection tube.

* * * * *